US010456650B2

(12) United States Patent
Kim

(10) Patent No.: US 10,456,650 B2
(45) Date of Patent: Oct. 29, 2019

(54) BAT FOR GOLF SWING PRACTICE

(71) Applicant: BESCON Co., Ltd., Daejeon (KR)

(72) Inventor: Kyung-Chul Kim, Daejeon (KR)

(73) Assignee: BESCON Co., Ltd., Daejeon (KR)

( * ) Notice: Subject to any disclaimer, the term of this patent is extended or adjusted under 35 U.S.C. 154(b) by 6 days.

(21) Appl. No.: 15/735,358

(22) PCT Filed: Jun. 11, 2015

(86) PCT No.: PCT/KR2015/005898
§ 371 (c)(1),
(2) Date: Dec. 11, 2017

(87) PCT Pub. No.: WO2016/199962
PCT Pub. Date: Dec. 15, 2016

(65) Prior Publication Data

US 2018/0169500 A1 Jun. 21, 2018

(30) Foreign Application Priority Data

Jun. 11, 2015 (KR) ..... 10-2015-0082782

(51) Int. Cl.
*A63B 69/36* (2006.01)
*A63B 57/00* (2015.01)
(Continued)

(52) U.S. Cl.
CPC ..... *A63B 69/3632* (2013.01); *A63B 57/00* (2013.01); *A63B 59/00* (2013.01);
(Continued)

(58) Field of Classification Search
CPC . A63B 69/3632; A63B 69/3605; A63B 60/46; A63B 59/00
(Continued)

(56) References Cited

U.S. PATENT DOCUMENTS 8,257,191 B2 * 9/2012 Stites ..... A63B 69/36 473/223
8,715,096 B2 * 5/2014 Cherbini ..... G09B 19/0038 473/131
(Continued)

FOREIGN PATENT DOCUMENTS

KR 10-0982482 B1 9/2010
KR 10-2011-0122656 A 11/2011
(Continued)

OTHER PUBLICATIONS

WO 2014178604 Bescon Co Translation, Nov. 6, 2004, All Pages.*
International Search Report for PCT/KR2015/005898 dated Oct. 19, 2015 from Korean Intellectual Property Office.

*Primary Examiner* — John E Simms, Jr.
*Assistant Examiner* — Rayshun K Peng
(74) *Attorney, Agent, or Firm* — Paratus Law Group, PLLC

(57) ABSTRACT

The present invention relates to a practice swing bat and, particularly, to a bat which is capable of, during golf swing practice, calculating and displaying swing speed, virtual driving distance of each club, etc., and transmitting the same to a terminal so as to enable management of the same. To this end, the bat of the present invention comprises a swing measurement module.

1 Claim, 8 Drawing Sheets

(51) Int. Cl.

| | |
|---|---|
| ***A63B 59/00*** | (2015.01) |
| ***A63B 60/46*** | (2015.01) |
| ***A63B 60/28*** | (2015.01) |
| ***A63B 71/06*** | (2006.01) |
| *A63B 59/80* | (2015.01) |

(52) U.S. Cl.
CPC ..... *A63B 60/28* (2015.10); *A63B 60/46* (2015.10); *A63B 69/36* (2013.01); *A63B 71/0622* (2013.01); *A63B 59/80* (2015.10); *A63B 2071/0655* (2013.01)

(58) Field of Classification Search
USPC ..... 473/219
See application file for complete search history.

(56) References Cited

U.S. PATENT DOCUMENTS

| | | | | |
|---|---|---|---|---|
| 9,636,578 | B1 * | 5/2017 | Ricky | A63F 13/245 |
| 2013/0095940 | A1 * | 4/2013 | Dugan | A63B 69/3623 473/222 |

FOREIGN PATENT DOCUMENTS

| | | | |
|---|---|---|---|
| KR | 10-2015-0045262 | A | 4/2015 |
| WO | WO 2014/178604 | A1 | 11/2004 |
| WO | WO 2013/108945 | A1 | 7/2013 |

* cited by examiner

BAT FOR GOLF SWING PRACTICE

CROSS REFERENCE TO PRIOR APPLICATIONS

This application is a National Stage Patent Application of PCT International Patent Application No. PCT/KR2015/005898 (filed on Jun. 11, 2015) under 35 U.S.C. § 371, which claims priority to Korean Patent Application No. 10-2015-0082782 (filed on Jun. 11, 2015), which are all hereby incorporated by reference in their entirety.

TECHNICAL FIELD

The present invention relates to a bat for golf swing practice. The present invention relates to a bat for practicing swings and, more particularly, to a bat that can not only calculate and display the swing speed, the virtual driving distance for each club, etc., but also transmit the results to a terminal for management when the user practices golf swings. Also, a bat for golf swing practice based on the present invention recognizes the swing plane during a swing practice and transmits the swing plane to a terminal, enabling the user to personally check the result.

BACKGROUND ART

For a more enjoyable game of golf and to lower one's score, one has to hit the golf ball exactly with the face of a club, such as a driver, wood, iron, etc. To do so, it is important to establish an always consistent swing posture.

A golf swing performed as a rhythmical action not only enables a stable posture but also results in a stable trajectory of the golf ball and driving distance when an exact impact is achieved with each club. A golf swing may be divided into roughly seven steps, including the address, backswing, backswing apex (backswing top), downswing, impact, follow-through, finish, etc.

Korean Registered Patent No. 10-0982482 was provided for stable swing practice. The swing practice bat of the above registered patent lets the user know when the bat has reached the backswing apex point and the finish point by means of a sound made as a notifying ball impacts an alarm tube. In an indoor driving range, etc., the impact noise is not easily heard due to the noise made by other users practicing, etc. In making a golf swing, which requires concentration, this impact noise may disrupt the user's own swing practice. Also, the user has to burden the cost of buying a separate practice bat, and there is a lack of realism as the user has to practice swings with a practice bat that is different from a golf club.

When practicing golf swings, the address (posture) is important. For a user to check whether or not a normal address is being made, the user checks the so-called lie angle. Generally, the lie angle refers to the rear-side angle formed between the shaft of the golf club and the ground surface during the address. Generally, when a wedge is used, which has a shaft of a shorter length, the lie angle is greater, and conversely when a driver is used, the lie angle is smaller. Also, considering a specific golf club, a lie angle that is greater than normal (for example, when the distance between the golf ball and the tip of the foot is farther than normal) causes the heel portion of the golf club to be raised up from the ground surface. A lie angle that is smaller than normal (for example, when the distance between the golf ball and the tip of the foot is closer than normal) causes the toe portion of the golf club to be raised up from the ground surface. When the heel portion is raised up, the golf ball flies more to the right from the intended target direction. An effect comparable to a slice or a fade is obtained. When the toe portion is raised up, the golf ball would fly more to the left from the intended target direction. An effect comparable to a hook or a draw is obtained. It may thus be said that it is important for a user to check the lie angle during the address based on his/her own posture.

Also, there is a need for a device that can measure swing speed during use of the practice bat, so as to virtually estimate the driving distance for each corresponding club, and enable the user to check whether or not the strength, etc., of the shaft of the golf club owned by the user is adequate for the swing speed, etc., for suitable club fitting.

Furthermore, there is a need for a device that can measure the swing speed and predict the distance as converted for each club, to allow the user to maintain a consistent swing tempo. Also needed is a device that allows the user to check the swing trajectory, i.e. the swing plane, during swing practice and thus maintain a consistent swing plane.

DISCLOSURE

Technical Problem

The present invention aims to resolve the problems above. More specifically, an objective of the present invention is to provide a bat that may be variably adjusted in length, in consideration of the fact that golf clubs can have different lengths, and can measure the user's swing speed to virtually display the driving distance if a golf ball were hit in such manner.

Also, another objective of the present invention is to enable the user to compare the address point and impact point and check whether or not the exact impact point was achieved, etc., by having the bat recognize the swing trajectory.

Another objective is to allow the user to check whether or not a club carried by the user is suitable for the user and thus provide information helpful for club fitting by having the bat calculate and display the speed by which it is swung.

Technical Solution

The present invention includes a head 100; a first shaft 200 connected to one end of the head 100; a length adjustment part 300 connected with the first shaft 200; a second shaft 400 connected with the length adjustment part 300 and having a grip 410 formed at one end thereof to allow a gripping by a hand of a user; and a swing measurement module 500 mounted on at least one of the head 100, the first shaft 200, the length adjustment part 300, and the second shaft 400, wherein the swing measurement module 500 comprises: a swing speed measurement part 520 for measuring a swing speed of the user from a backswing apex point to a follow swing point; a mode setting part 550 for selecting a type of golf club according to a fixed length after a length adjustment by the length adjustment part 300; and a driving distance conversion part 530 for comparing the swing speed recognized at the swing speed measurement part and a club set at the mode setting part 550 and converting the swing speed to the driving distance that would be obtained if a golf ball were virtually hit.

The swing measurement module 500 of the present invention may recognize the point at which the user makes an address for a practice swing, may further comprise a first sensor for recognizing a lie angle between the first shaft and a ground surface, and may further comprise a lie angle indicator part 510 for indicating the lie angle recognized by the first sensor.

The swing measurement module 500 of the present invention may further include: a second sensor for recognizing a trajectory of a swing during a practice swing by the user; and a transmission part for transmitting the recognized trajectory from the second sensor to a separate mobile device.

Inside the head 100 of the present invention, there may be included a notifying means 140, the notifying means 140 comprising: a tube body 141 having a hollow inside; a movable body 142 configured to move within the tube body and made of a paramagnetic substance; a magnetic body 143 disposed on one side of the tube body 141; and a fixed part 144 that is secured penetrating through an inside of the magnetic body 143 and is made of a paramagnetic substance such that the magnetic property of the magnetic body 143 is transferred to the movable body 142 for a magnetic coupling with the movable body 142, while the swing measurement module 500 may further include an impact check part 540 for comparing and checking whether or not a point at which the movable body 142 detaches from the fixed part 144 and reaches the other side of the tube body 141 during a trajectory beginning at a downswing, passing through an impact point, and arriving at a follow-through, in a practice swing by the user, is in agreement with an impact point of a swing trajectory recognized by the second sensor.

Inside the head 100 of the present invention, there may further be included a vibration part 150 for informing the user of an address point in a tactile manner during a practice swing by the user.

Advantageous Effects

The present invention provides a bat that may be variably adjusted in length, in consideration of the fact that golf clubs can have different lengths, and can measure the user's swing speed to virtually display the driving distance if a golf ball were hit in such manner.

Also, a bat based on the present invention may recognize the swing trajectory to allow the user to compare the address point and impact point and check whether or not the exact impact point was achieved, etc.

A bat based on the present invention may calculate and display the speed by which it is swung, thereby providing information helpful for club fitting by allowing the user to check whether or not a club carried by the user is suitable for the user.

MODE FOR INVENTION

A detailed description of the present invention is provided below with reference to the accompanying drawings.

Figure 1:
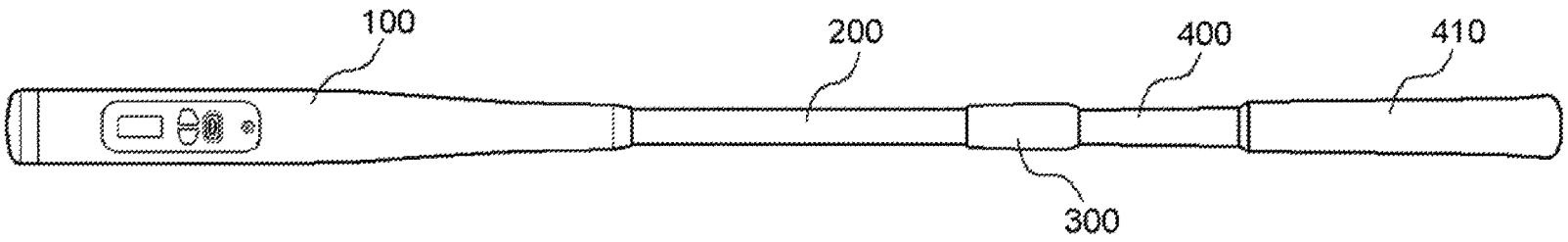
FIG. 1 is a conceptual diagram illustrating a bat based on the present invention.

Referring to FIG. 1, the present invention includes, among others, a head 100, a first and a second shaft 200, 400, a length adjustment part 300 capable of variably adjusting the total length of the shaft, and a grip 410 provided at the end portion of the second shaft.

Figure 5:
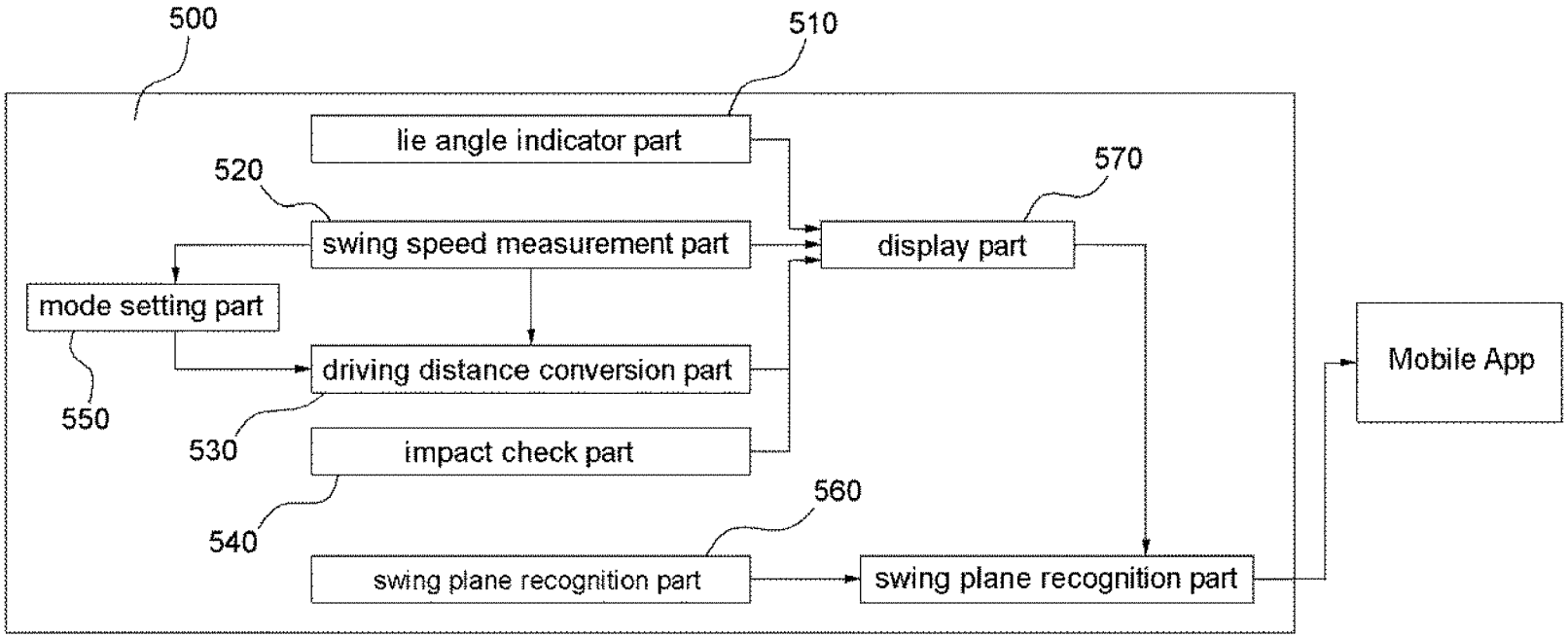
FIG. 5 is a block diagram conceptually illustrating the swing measurement module of a bat based on the present invention.

Referring to FIG. 5, the present invention includes, among others, a swing measurement module 500 capable of measuring the swing speed, lie angle, swing trajectory, swing plane, etc., of the user, a battery 600 for supplying power to the swing measurement module 500, and a charger part 700 for charging the battery 600.

Referring to FIG. 1, the head 100 of the present invention is on the opposite side of the portion gripped by the user and is preferably heavier than the grip 410 side. To this end, referring to FIG. 2, a weight piece 130 may be provided in an inner portion of the head 100. Preferably, the weight piece 130 may be inserted and secured after releasing a cap 120 fastened to the end portion side of the head 100. It is preferable that the weight piece 130 have a variable weight, in order to allow adjustments according to the strength, build, gender, etc., of the user. This is possible by varying the size of the weight piece 130 or by varying the density for a weight piece 130 of the same size.

Referring to FIG. 1, an auxiliary notifying part 110 is provided on the inner side of the head 100. The auxiliary notifying part 110 has the shape of a hollow pipe having a hollow inside and is provided with an auxiliary movable body 112 placed within. A magnet 111 is provided on one side of the hollow pipe shape. The auxiliary movable body 112 is preferably of a paramagnetic substance. As the auxiliary movable body 112 draws close to the magnet 111 side, the two are magnetically coupled. During the initial address made by the user, the auxiliary movable body 112 is positioned at the opposite direction of the magnet 111 due to its own weight. As the backswing is made, the weight of the auxiliary movable body 112 causes it to be magnetically coupled to the magnet 111. During the downswing, the auxiliary movable body 112 is prevented from becoming detached from the magnet 111 by the magnetic force. Only at the exact impact point is the auxiliary movable body 112 detached from the magnet 111 by its own weight and the centrifugal force, etc., and dropped strongly in the opposite direction. As the auxiliary movable body 112 collides with a partition wall at the other side of the hollow pipe shape described above or with a separate noise-inducing disk 113, a noise is created by the collision.

The magnet 111 described above may be a separate disk 111 that does not have a magnetic quality. In this case, at the time of the initial address, the auxiliary movable body 112 is at the side of the disk 113, and during the backswing or after arriving at the backswing apex, is dropped to the disk 111 that is not magnetic. In this case also, the auxiliary movable body 112 is detached from the disk 111 due to self-weight and centrifugal force, etc., and collides with the other disk 113 to create a noise only when the exact impact point is reached. Thus, the user may know where the impact occurs.

A description of the swing measurement module 500 is provided below, with reference to FIGS. 2 to 6.

Figure 2:
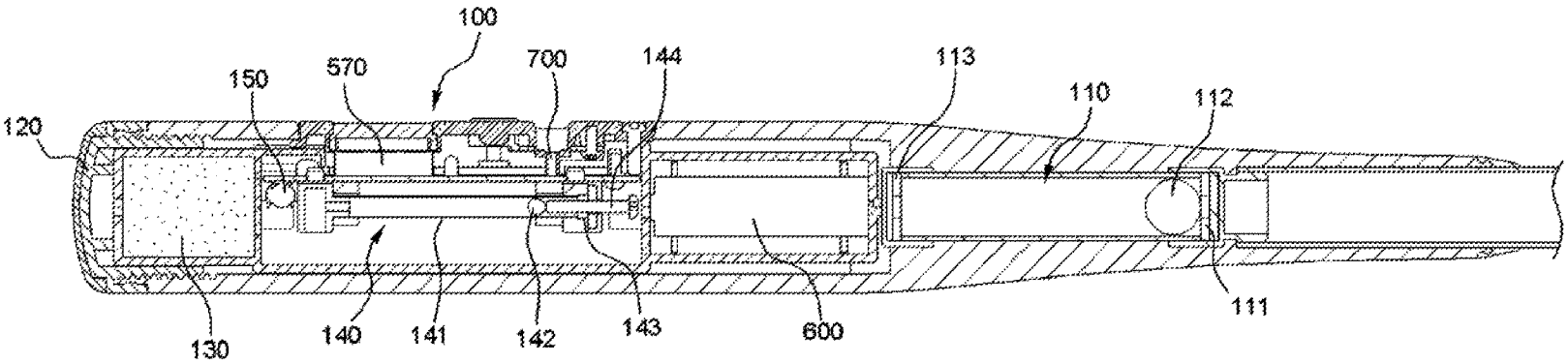
FIG. 2 is a conceptual diagram illustrating the cross section of the head portion of a bat based on the present invention.

Referring to FIGS. 2 and 5, the swing measurement module 500 includes, among others, a lie angle indicator part 510, a swing speed measurement part 520, a driving distance conversion part 530, an impact check part 540, a mode setting part 550, a swing plane recognition part 560, a display part 570, and a transmission part.

Referring to FIG. 5, the data and images, etc., including the swing plane, etc., measured and processed at the swing measurement module 500 may be transmitted to a separately provided mobile device to be displayed and managed by an app installed thereon. Preferably, the swing measurement module 500 and the mobile device use a known near-field communication method, more preferably a near-field wireless communication method such as NFC, Bluetooth, etc.

Figure 7:
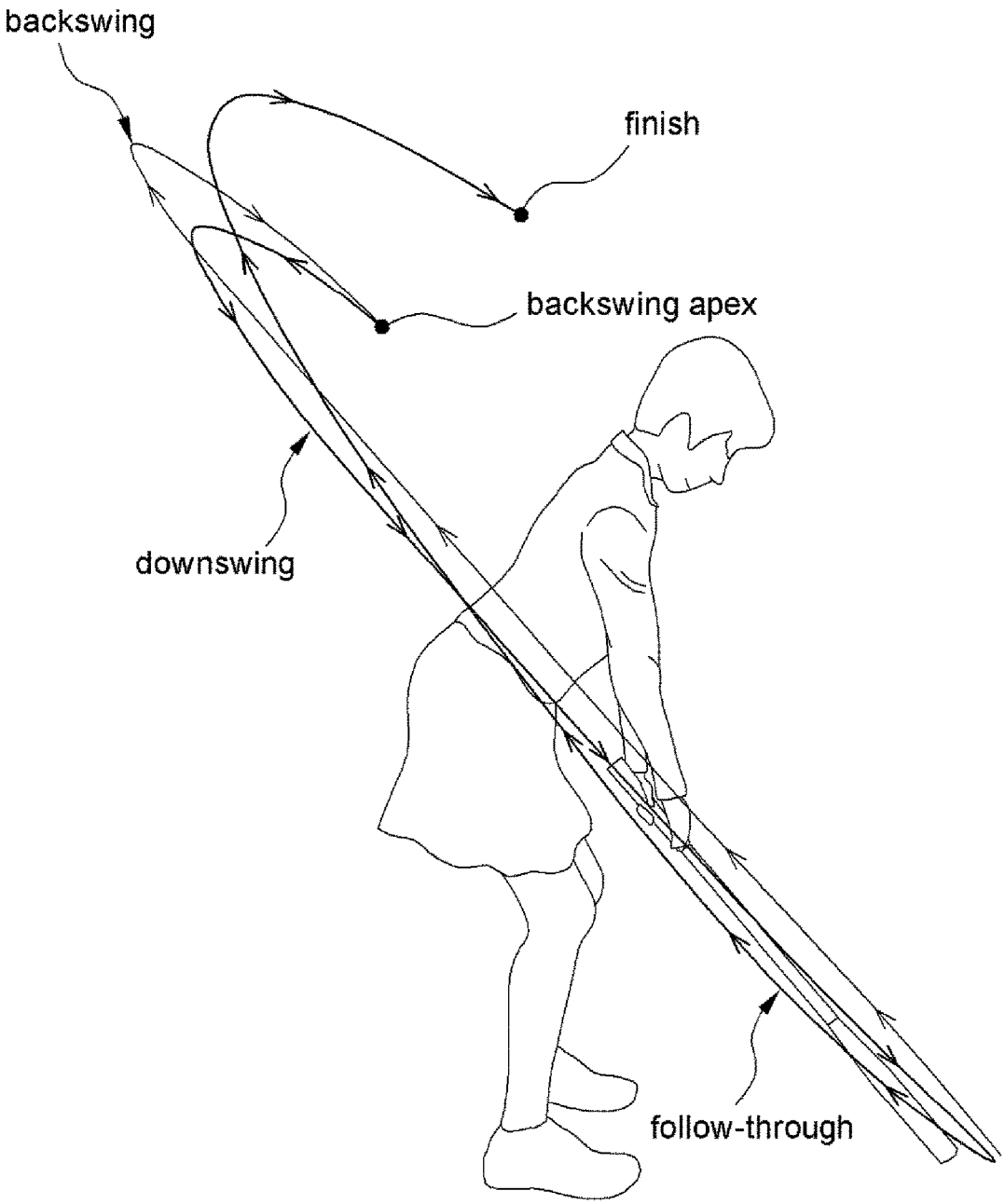
FIG. 7 is a conceptual diagram illustrating how the trajectory of a practice swing using a bat based on the present invention may be shown as a side view on a mobile device.
Figure 8:
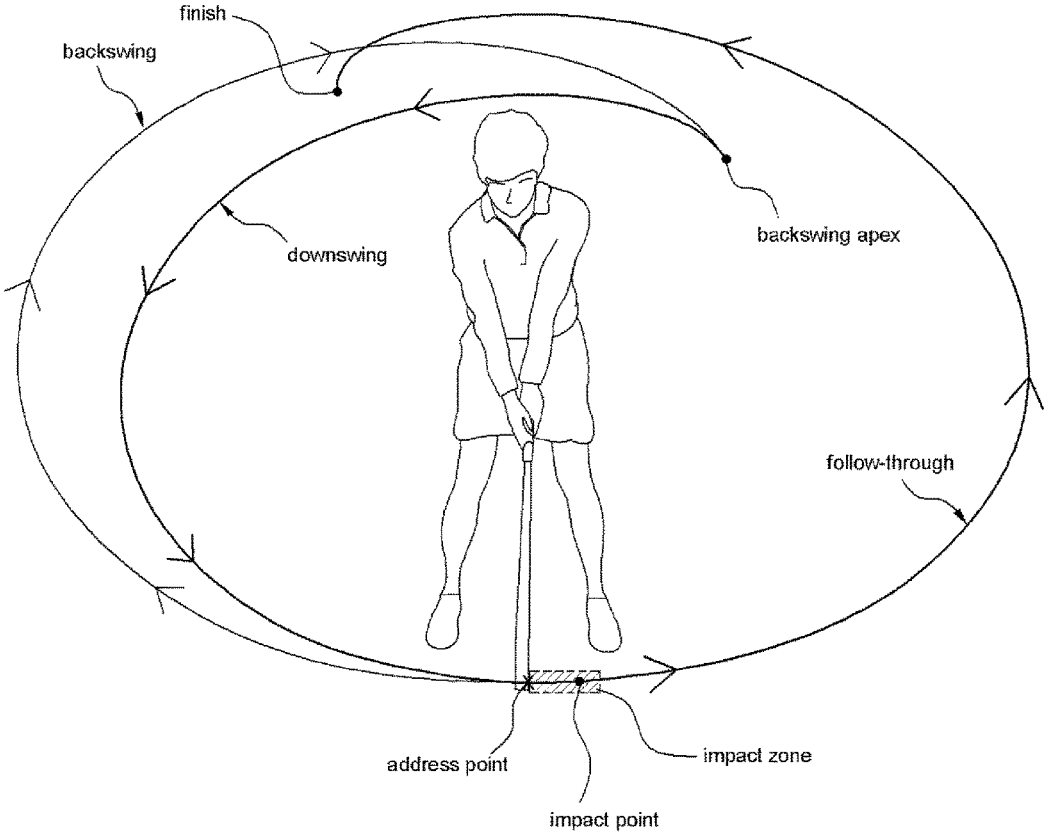
FIG. 8 is a conceptual diagram illustrating how the trajectory of a practice swing using a bat based on the present invention may be shown as a front view on a mobile device.

Although there are no specific examples illustrated as regards the images, etc., of the app implemented on the mobile device, it would be conceivable to display a swing plane showing the swing trajectory, as in FIGS. 7 and 8.

FIG. 2 illustrates the swing measurement module 500 as being mounted on the inside at the center of the head 100. However, this is merely an example, and the swing measurement module 500 may be mounted on at least one of the first shaft 200, length adjustment part 300, and second shaft 400. Alternatively, it may be provided as a separate component and mounted on the exterior of a bat based on the present invention. There is no particular limit in terms of the mounting position. It may be preferable to arrange the swing measurement module 500 at the head 100 portion to allow the user to check the swing trajectory.

Referring to FIG. 5, the swing measurement module of the present invention includes a first sensor (not shown). It is sufficient that the first sensor be a sensor capable of measuring the angle between the ground surface and a line linearly extending the first and second shafts 200, 400 to the ground surface, during the initial address made by the user. For example, a gyro sensor, an acceleration sensor, or the like, may be utilized. The task of calculating the lie angle measured by the first sensor and transmitting the lie angle to the display part 570 is performed by the lie angle indicator part 510. The user may check the indicated lie angle to visually see whether or not the address was satisfactory, etc.

Referring to FIG. 5, the swing speed measurement part 520 measures the swing speed within the section ranging from the user's backswing apex to the finish. This may be utilized for club fitting, as the user may compare the specifications for the driver, wood, iron clubs, etc., currently carried by the user with the measured speed and thus check whether or not the clubs carried by the user are suitable. Also, if the measured swing speeds are irregular, one may repeat the practice swings to achieve a consistent swing speed and tempo. Similarly, it is possible to measure the swing speed by utilizing a gyro sensor or acceleration sensor (not shown), etc.

Figure 6:
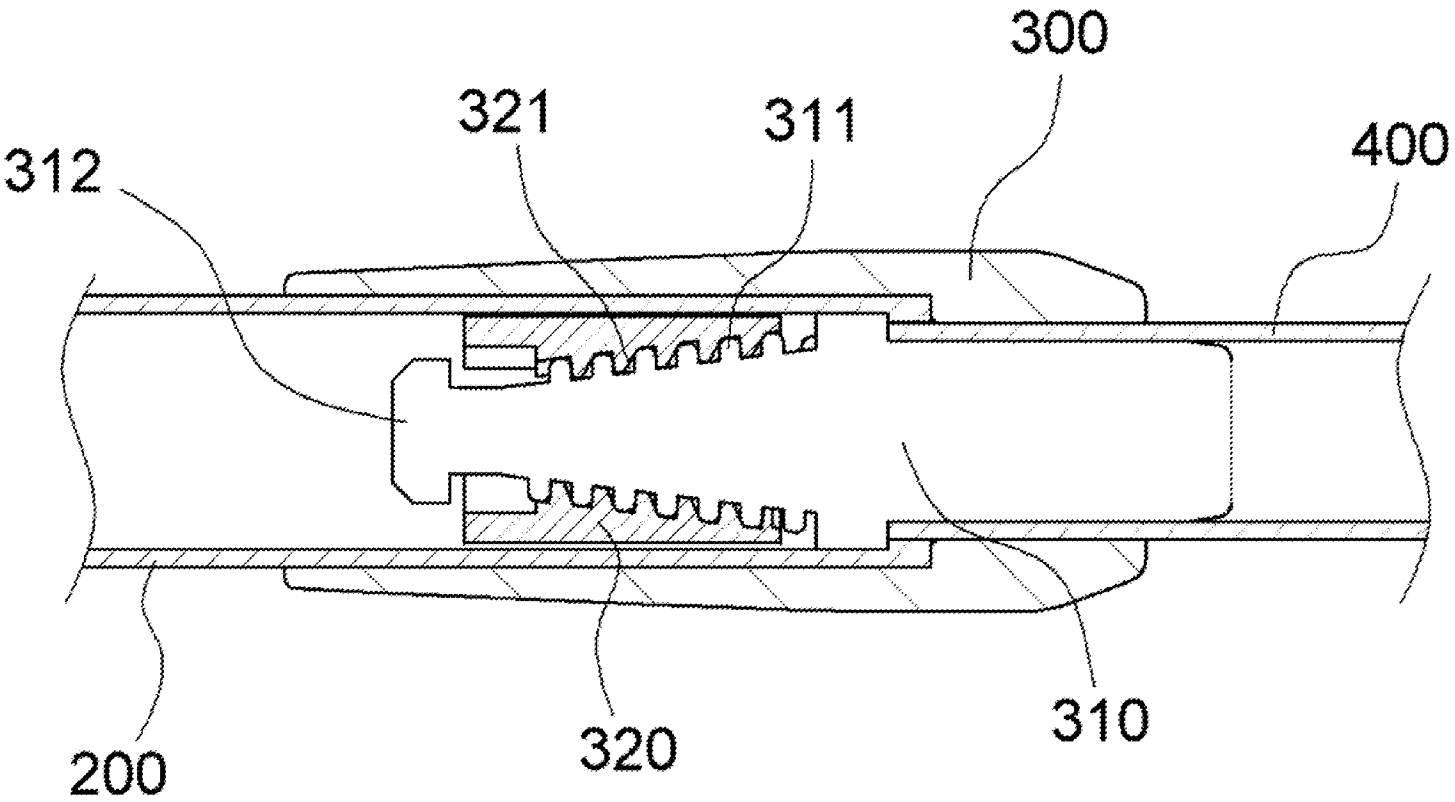
FIG. 6 is a conceptual diagram illustrating the length adjustment part, etc., of a bat based on the present invention.

Referring to FIG. 6, the swing speed is converted to the driving distance of a virtual golf ball, supposing that there was an exact hit with the swing speed measured via the swing speed measurement part 520. There are about fourteen types of golf clubs, from the driver to the putter. A more enjoyable workout may be achieved by allowing the user to recognize the exact driving distance for each club, other than the putter. Each user may enter a virtual setting and get the result, for example, of about 200 m for a driver, about 130 m for the 7 iron, etc. To allow the user to check the virtual driving distance of a golf ball using a bat based on the present invention, a separate mode setting part 550 is provided. Using the mode setting part 550, the user may set the current practice mode to the driver mode, 7 iron mode, etc. After comparing the measured swing speed and the practice mode setting, the driving distance conversion part 530 converts the swing speed to a virtual golf ball driving distance.

Methods of conversion may include using a separate empirical formula, using statistical conversion based on a database of swing speeds and driving distances achieved by professional golfers, and the like.

For the conversion of the virtual golf ball driving distance and for a more enjoyable and accurate practice experience by the user, a length adjustment part 300 is provided, in consideration of the fact that each club has a shaft of a different length. By manipulating the length adjustment part 300 to match the length of a driver shaft used to practice a swing, and entering a driver mode as the setting for the mode setting part 550, the user may obtain a more accurate virtual golf ball driving distance converted from the corresponding swing speed.

Referring to FIG. 5, a swing plane recognition part 560 having a second sensor is provided. The swing plane recognition part 560 may read the trajectory of the practice swing made by the user and may recognize this as a swing trajectory, which is expressed in a linear form, a swing plane, which is expressed in a planar form, and the like. The recognized swing trajectory and swing plane may be transmitted via a transmission part to a mobile device to be displayed via an app installed on the device. The second sensor may be an acceleration sensor or a gyro sensor. Other types of sensors capable of recognizing the swing trajectory, etc., may also be utilized.

A description of the impact check part 540 is provided below with reference to FIG. 5. The impact check part 540 compares and checks whether or not the point at which the movable body 142, described later on, becomes detached from the fixed part 144 and reaches the other side of the tube body 141 during the trajectory beginning at the downswing, passing through the impact point and arriving at the follow-through, in a practice swing by the user, is in agreement with the impact point recognized by the second sensor.

Alternatively, the impact check part 540 recognizes the initial address of the user by way of the first or second sensor, etc., and then checks whether the impact point recognized after the backswing apex and downswing is in agreement or the impact point has reached the impact zone as in FIG. 8 rather than the address point and transmits the results to the display part 570. If an exact impact was achieved, the display part 570 may indicate the virtual golf ball driving distance or swing speed, etc. If an exact impact was not achieved, an error message may be shown. The display method of the display part 570 may be modified in various ways.

Figure 3:
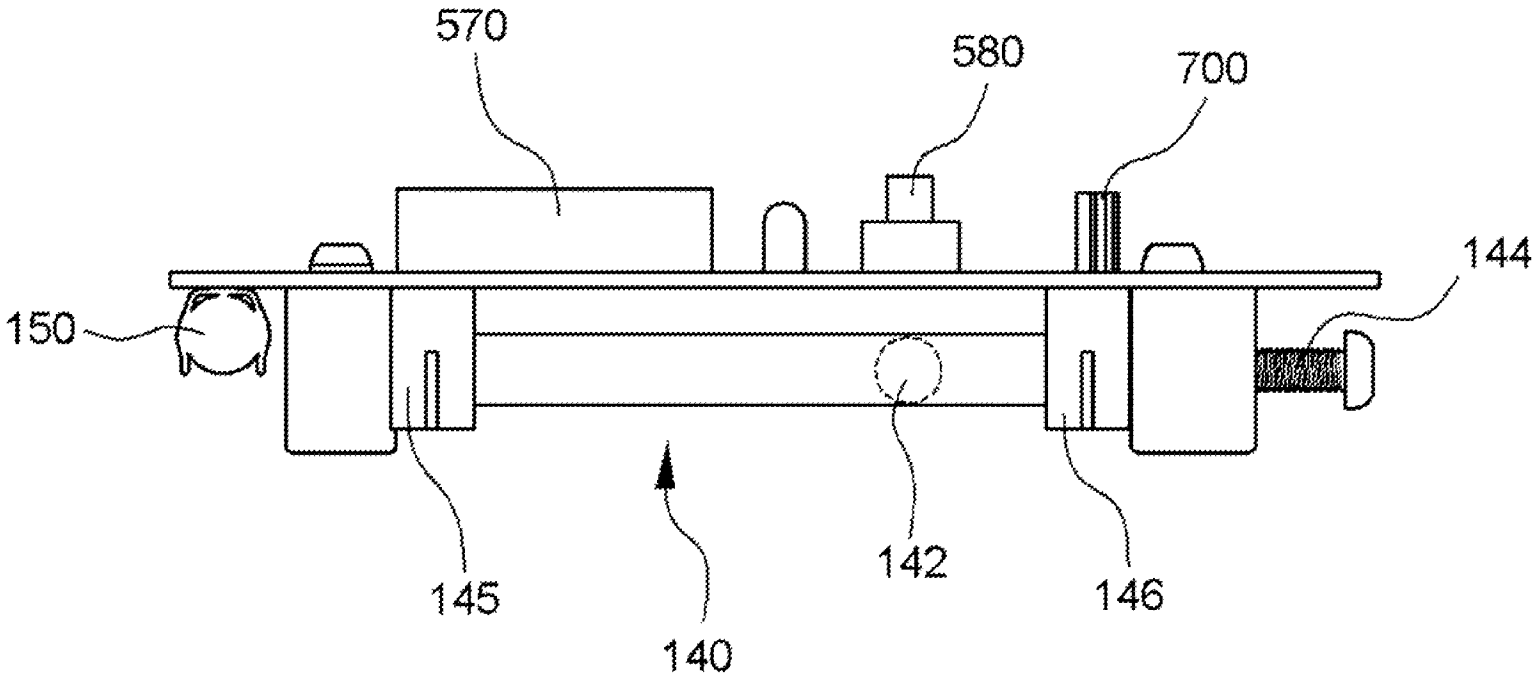
FIG. 3 is a conceptual diagram illustrating the swing measurement module and notifying means of a bat based on the present invention.
Figure 4:
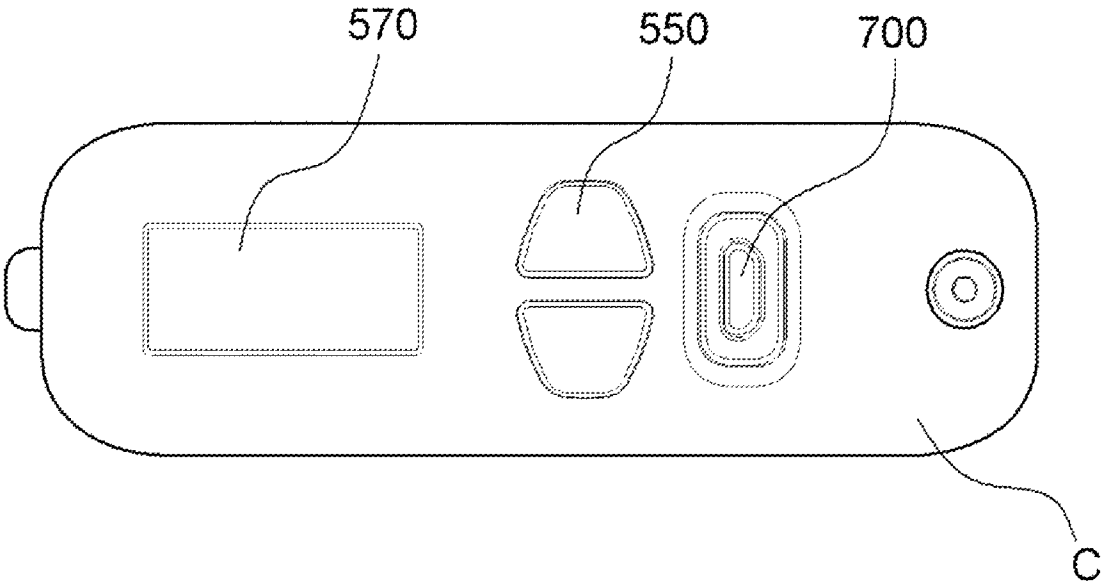
FIG. 4 is a conceptual diagram illustrating the cover at the swing measurement module of a bat based on the present invention.

FIGS. 2 to 4 illustrate the swing measurement module 500 mounted inside the head 100, as well as the battery 600, charger part 700, etc., accompanying the module. Referring to FIGS. 2 to 4, it can be seen that a separate display part 570 and power button 580 are provided on the PCB.

Referring to FIG. 3, a notifying means 140 is provided on the underside of the PCB. Similarly to the auxiliary notifying means 110 described above, the notifying means includes a tube body 141 having a hollow inside, a movable body 142 that moves inside the tube body 141 and is made of a paramagnetic substance, a magnetic body 143 provided on one side of the tube body 141, and a fixed part 144 that is secured penetrating through the inside of the magnetic body 143 and is made of a paramagnetic substance to transfer the magnetic property of the magnetic body 143 to the movable body 142 and enable a magnetic coupling of the movable body 142. The fixed part 144 may be a screw made of a paramagnetic substance. By rotating the fixed part 144 in a regular or a reverse direction, the movable body 142 can be placed farther from or closer to the secured magnetic body 143. Thus, the strength of the magnetic force applied by the magnetic body 143 on the movable body 142 may be adjusted. The operating mechanism of the movable body 142 is substantially the same as that of the auxiliary movable body 112 in the auxiliary notifying part 110 described above.

That is, when the backswing apex is reached, the movable body 142 is magnetically coupled to the fixed part 144. After the downswing when the impact point is reached, the movable body 142 is detached to the opposite side of the fixed part 144 due to self-weight and centrifugal force, etc.

Supposing that the point at which the movable body 142 drops to the opposite side of the fixed part 144 is the impact point, as described above, this point is compared with the impact point of the swing trajectory recognized by the first or second sensor, whereby it can be checked whether or not an exact impact was achieved, as described above.

A description of the length adjustment part 300 is provided below with reference to FIG. 6.

The length adjustment part includes a rotation part 310 and an extension part 320. Referring to FIG. 6, one side of the rotation part is secured to the inner surface of the second shaft 400. If the second shaft 400 is rotated, the rotation part 310 secured thereto as an integrated body is rotated together. The other side of the rotation part 310 has a conical cross section with a male thread 311 formed on the outer perimeter. The extension part 320 has a female thread 321 formed on the inner surface to mate with the male thread.

When the rotation part 310 is rotated in the regular direction, the rotation part 310 moves forward towards the inside of the extension part 320, so that the extension part 320 is increasingly pushed wider. The outer perimeter of the widened extension part 320 presses against the inner perimeter of the second shaft 400. Thus, securing is achieved. Conversely, when rotated in the reverse direction, the rotation part 310 moves backward towards the outside of the extension part 320, so that the widened extension part 320 is restored and loosened. In this manner, length adjustments are enabled.

A bat based on the present invention enables the user to recognize and improve swing speed. The user may also maintain a consistent swing speed. This may be converted into the driving distance of a virtual golf ball and displayed, providing increased enjoyment. As the shaft may be adjusted in length, the user may practice effectively with one bat simulating practice for different clubs.

INDUSTRIAL APPLICABILITY

The present invention relates to a bat for golf swing practice. The present invention relates to a bat for practicing swings and, more particularly, to a bat that can not only calculate and display the swing speed, the virtual driving distance for each club, etc., but also transmit the results to a terminal for management when the user practices golf swings. Also, the bat for golf swing practice based on the present invention recognizes the swing plane during a swing practice and transmits the swing plane to a terminal, enabling the user to personally check the result.

The invention claimed is:

1. A bat for golf swing practice, the bat comprising:

a head including:

a tube body provided inside the head and having a hollow inside, a first side, and a second side opposite to the first side;

a movable body configured to move within the tube body and made of a paramagnetic substance;

a magnetic body disposed on the first side of the tube body; and a screw made of a paramagnetic substance, penetrating through an inside of the magnetic body, and configured to hold the movable body at the first side of the tube body by a magnetic force transferred from the magnetic body;

a first shaft connected to one end of the head;

a length adjustment part connected with the first shaft;

a second shaft connected with the length adjustment part and having a grip formed at one end thereof to allow a gripping by a hand of a user; and a swing measurement module mounted on at least one of the head, the first shaft, the length adjustment part, and the second shaft, wherein the swing measurement module comprises:

a first sensor, including a gyro sensor or an acceleration sensor, configured to measure a swing speed of the user from a backswing apex point to a follow swing point; and a second sensor, including a gyro sensor or an acceleration sensor, configured to recognize a swing trajectory, beginning at a downswing, passing through an impact point, and arriving at a follow-through, during a practice swing by the user, wherein the swing measurement module is configured to compare and check whether or not a point at which the movable body being detached from the screw reaches the second side of the tube body during the practice swing by the user matches the impact point of the swing trajectory recognized by the second sensor, and is configured to display the compared and checked result through a display screen mounted on the bat.

* * * * *